US007110101B2

(12) United States Patent
Schneider

(10) Patent No.: US 7,110,101 B2
(45) **Date of Patent: *Sep. 19, 2006**

(54) METHOD AND DEVICE FOR DETERMINING AN ANGULAR ERROR AND USE OF THE DEVICE

(76) Inventor: Gabriel Schneider, Frohbülstrasse 2, CH-8052 Zürich (CH)

( * ) Notice: Subject to any disclaimer, the term of this patent is extended or adjusted under 35 U.S.C. 154(b) by 306 days.

This patent is subject to a terminal disclaimer.

(21) Appl. No.: 10/461,743

(22) Filed: Jun. 13, 2003

(65) Prior Publication Data

US 2003/0231299 A1 Dec. 18, 2003

(Under 37 CFR 1.47)

(30) Foreign Application Priority Data

Jun. 14, 2002 (CH) ..... 1025/02

(51) Int. Cl.
*G01B 11/26* (2006.01)
*G01C 1/00* (2006.01)

(52) U.S. Cl. ..... 356/139.06; 356/141.1; 356/152.3; 356/139.04

(58) Field of Classification Search ... 356/141.1–152.3, 356/139.04, 139.06; 250/203.6; 89/41.05, 89/41.06

See application file for complete search history.

(56) References Cited

U.S. PATENT DOCUMENTS 4,142,799 A 3/1979 Barton
4,606,256 A * 8/1986 De'Ath ..... 89/41.09
4,665,795 A * 5/1987 Carbonneau et al. ..... 89/41.03
5,208,418 A * 5/1993 Toth et al. ..... 89/41.07
5,285,273 A * 2/1994 James et al. ..... 89/41.05
5,456,157 A * 10/1995 Lougheed et al. ..... 89/134
5,686,690 A * 11/1997 Lougheed et al. ..... 89/41.17
6,097,481 A * 8/2000 Coffey et al. ..... 356/139.05
6,265,704 B1 * 7/2001 Livingston ..... 250/203.2
6,497,171 B1 * 12/2002 Gerber et al. ..... 89/41.09

FOREIGN PATENT DOCUMENTS

| | | |
|---|---|---|
| DE | 29 51 108 A1 | 7/1981 |
| EP | 0 095 577 A | 12/1983 |
| EP | 0 179 387 A | 4/1986 |
| EP | 0 383 043 A | 8/1990 |
| EP | 1 217 324 A1 | 6/2002 |
| FR | 2 505 477 A | 11/1982 |
| WO | WO 88 08952 A | 11/1988 |

* cited by examiner

*Primary Examiner*—Bernarr E. Gregory
*Assistant Examiner*—Isam Alsomiri

(57) ABSTRACT

A method and a device are disclosed for establishing actual changes and intended changes of the spatial angle of a main axis (e) of a sensor or effector attached to a receiver (4.1). The receiver (4.1) is directly rotatable around the first axis of rotation (I) and indirectly rotatable around at least one further axis of rotation (b, a). An optical-electronic angular measurement device (5) having at least two measurement axes is attached to the receiver (4.1). For a first axis of rotation (I, b, a), a rotation is performed around this first axis of rotation (I, b, a), while any rotation around further axes of rotation is prevented. After each rotation step, a first actual change of the spatial angle of the main axis (e) is detected and stored by the angular measurement device (5), and a first intended change of the spatial angle of the main axis (e) is provided and stored by a coder device (10). During use of the device, a carrier base (8), onto which the receiver (4.1) is attached via a carrier (6), is directly or indirectly attached to a movable mounting surface (1).

28 Claims, 2 Drawing Sheets

METHOD AND DEVICE FOR DETERMINING AN ANGULAR ERROR AND USE OF THE DEVICE

CROSS REFERENCE TO PRIOR APPLICATION

Applicant hereby claims foreign priority under 35 U.S.C. § 119 from Swiss Patent Application No. 2002 1025/02 filed 14 Jun. 2002, the disclosure of which is herein incorporated by reference.

BACKGROUND OF THE INVENTION

The present invention relates to a method of establishing actual changes and intended changes of a spatial angle of a sensor or effector axis attached to a receiver directly rotatable around a first axis and indirectly rotatable around at least one additional axis. The invention is also directed to a device useful in performing the method.

As an example, but without any restrictive effect, in the following the problem upon which the present invention is based is to be described with reference to a tracking device, such as a tracking device having a sensor or effector, the tracking device being positioned on a movable mounting surface, such as a vehicle or ship deck. For example, the sensor may be an image recording device and the effector may be a weapon barrel of an artillery weapon, the main optical axis of the image recording device and/or the core axis of the weapon barrel able to be considered at least approximately the main axis. The sensor and/or effector is to be movable in such a way that its alignment and/or the alignment of its main axis is always correlated with the position of an external object which moves in relation to the sensor and/or effector and thus follows the object; in the case of a sensor, this means that it is always pointed directly at the moving target, while in the case of an effector implemented as a weapon barrel, this generally means that it is pointed at a point which the object only reaches later, so that the projectile fired from the weapon barrel hits the object at the point cited.

The sensor and/or effector is rigidly attached to a receiver, together with which it essentially forms one actual functional unit. The receiver is rotatably connected to a carrier via an axis of elevation; the elevation of the sensor and/or effector may be set essentially through a rotation of the receiver in relation to the carrier around the axis of elevation; it is assumed that the main axis runs horizontally in the rest position. The carrier is rotatably connected to a carrier base via a roll axis; the effect of a rolling movement may be compensated for through a rotation of the carrier in relation to the carrier base around the roll axis in such a way that the axis of elevation remains horizontal or deviates only briefly by a small value from the horizontal; the roll axis is perpendicular to the axis of elevation and at an angle of 60° to a lateral axis, for example. The carrier base is rotatably connected via the lateral axis, directly or indirectly, to the vehicle and/or ship deck; the lateral angle of the sensor and/or effector may essentially be set through a rotation of the carrier base around the lateral axis; the lateral axis is at least approximately vertically aligned in the rest position.

The directions and/or angles of the various axes of rotation indicated above are theoretical values which one attempts to maintain. The actual values of these directions and/or angles generally deviate from the theoretical values. The deviations are essentially based on the permissible manufacturing and mounting tolerances, in that relative movements generally do not occur precisely continuously but rather in steps, if small steps, and also on changes of the relative positions of the centers of gravity of individual elements of the tracking device during their movements. The results of the deviations and/or geometry errors cause the actual direction of the main axis of the sensor and/or effector to deviate from the theoretical and/or desired direction by a—generally spatial—angular error. In other words, during rotations around the axes of rotation, the actual changes of specific angles deviate from the intended changes of these angles. The intended changes are provided in this case by a coder device. The deviations of the actual changes from the intended changes is referred to as angular errors. The angular errors have an influence on the results of the functional unit, for example, on the precision with which a sensor measures an object.

The angular errors are generally established at the factory in the course of a testing method, in the scope of a quality check, for example. The angular errors are typically different for the individual tracking devices and/or tracking device types and therefore at least partially describe the individual tracking devices. The angular errors are stored for this purpose.

The angular errors are not to exceed certain limiting values. They may be compensated for, which may be performed either through hardware and/or apparatus by reworking and/or mounting corrections, or through software, by taking the angular errors established into consideration, for example in the analysis of the results of a sensor system.

Independently of whether the angular errors are only stored or whether they are compensated for, they must be measured.

For the measurement of such angular errors typical until now, a chain measurement has been performed. For this purpose, first leveling is performed, and subsequently measurement from one axis to the next, i.e., from the lateral axis to the roll axis and further to the axis of elevation, is performed step-by-step. Optical measuring devices are mainly used for this measurement, such as autocollimators, theodolites, mirrors, angle levels, and inclinometers. In addition, multiple adapters, holders, carriers, and equivalent masses are necessary. The multiple means necessary, their differing resolution and measurement precisions, and the necessity of working very precisely are disadvantages of the typical measurement method. However, its greatest disadvantage is that measurement errors accumulate due to the chain measurement and coupling errors are practically unavoidable.

It is therefore the object of the present invention, to specify a method of the type initially cited, using which the disadvantages of the typical method may be avoided;

to provide a device of the type initially cited, which allows problem-free performance of the method; and to suggest a use of the device.

SUMMARY OF THE INVENTION

This object is achieved according to the present invention which resides in one aspect to a method of establishing actual changes and intended changes of a spatial angle defined by a main axis of a sensor or effector. The sensor or effector is attached to a receiver which in turn is rotatable directly about a first axis of rotation and indirectly about at least one further axis. An optical-electronic measurement device is attached to the receiver and has at least two measurement axes. For a first axis of rotation, a determination procedure is performed, in which a rotation is accomplished in steps around the axis. Any rotation around at least one further axis is prevented. A first actual change of the spatial angle of the main axis is detected and stored by the angular measurement device. A first intended change of the spatial angle of the main axis is provided and stored by a coder device.

The present invention also resides in a device for establishing intended changes and actual changes of spatial angles of the main axis of the sensor or effector which may be attached to the receiver. The receiver is rotatable directly around the first axis of rotation and indirectly around at least one further axis of rotation. The device includes a coder device which is implemented for the purpose of providing the intended changes of the spatial angle of the main axis. An optical-electrical angular measurement device is attachable to the receiver which has at least two measurement axes to detect the actual changes of the spatial angle of the main axis during rotations around only one of the axes of rotation. A storage unit is also provided to store the intended and the actual changes. The receiver can also be attached to a carrier base via a carrier which in turn is attachable to a movable mounting surface. Moreover, the carrier and the carrier base can form parts of a tracking device which can be aligned with the position of an external object through correlation of the main axis.

The present invention is based on the use of an at least biaxial, preferably triaxial optical-electronic angular measurement device, such as a laser gyro, in any case an angular measurement device which does not require any fixed orientation in space and which always only indicates the respective angle changes. The angular measurement device and/or the laser gyro is mounted, generally temporarily for performing measurement procedures, instead of a sensor or effector or in addition to the sensor and/or effector, so that a measurement axis is as coincident as possible to the main axis or if necessary is as parallel as possible. Other mounting configurations are possible, but require coordinate transformations for an understandable analysis of the results. The functional unit includes the receiver and the sensor or effector and/or the angular measurement device.

Through the use of an angular measurement device like a laser gyro, which does not require any fixed orientation in space, in particular no leveling, the new measurement is significantly simplified in relation to the typical measurement and, in addition, is more precise. During movements of the receiver due to rotations around the lateral axis, the roll axis, and the axis of elevation, the angular measurement device always recognizes the actual changes of the angle of the main axis. Using movements around only one of the three axes of rotation at a time, the actual changes of the angle and/or the relative positions of the main axes may be determined. The movements performed are identical to those which the tracking device would also execute in use.

The measurement performed in this new way is very precise and reproducible. Since it is, after all, an end-to-end measurement, errors due to coupling are also dispensed with.

A few adapter parts may possibly be necessary for mounting the angular measurement device and/or laser gyro. It is significant that the mass and center of gravity ratios are not significantly changed by mounting the angular measurement device and/or laser gyro; mounting in addition to the effector functional unit only comes into consideration, aside from the spatial relationships, when the mass of the angular measurement device and/or of the laser gyro is relatively small; if the angular measurement device and/or the laser gyro is mounted instead of the sensor and/or effector, and if its mass is significantly smaller than that of the sensor and/or effector, a compensating equivalent mass is to be attached.

The results of the error measurement procedures are only conclusive if the arrangement is such that the angular measurement device is located in a precisely known position relative to the main axis of the effector and/or sensor; the arrangement is preferably such that a relevant measurement axis of the measurement axes of the optical-electronic angular measurement device exactly corresponds to the main axis, which must be verified before the actual measurement of the angular error. For this purpose, a movement around the axis of elevation may be performed. If the relevant measurement axis is actually coincident with the main axis, it describes a normal plane to the axis of elevation during the movement around the axis of elevation. If the relevant measurement axis is not coincident with the main axis, it describes a conical surface, whose tip lies in the intersection of the measurement axis and axis of elevation, during the movement around the axis of elevation. In this case, a correction must be performed, unless the included angle of the conical surface is nearly 180°. The correction may be performed using hardware or software, a correction using software generally being preferred.

After this correction, the actual error measurement is performed. For this purpose, a rotation is performed around one of the three axes of rotation at a time, i.e., around the axis of elevation or around the roll axis or around the lateral axis, while rotations around the two other axes of rotation are prevented. The rotations are performed step-by-step. After each rotation step, the intended change of the angle is provided by the coder device, and the optical-electronic angular measurement device and/or the laser gyro provides the corresponding actual change. The intended changes and actual changes which correspond to one another are stored in a storage unit.

The actual error measurement is now finished in a narrower sense. What follows now is an analysis of the results of this measurement.

The results of the error measurement, i.e. only the actual changes and the intended changes of the respective angle, are stored in the storage unit and, as already mentioned, may merely be used for the purpose of characterizing the individual tracking devices.

In general, the device has a data processing system and/or is coupled to such a system. Using a computer unit of the data processing system, a matrix may be produced using the results of the error measurement.

In general, angular errors, i.e., differences between the actual changes and the intended changes of the angle, are calculated using the computer unit.

These angular errors may either merely be stored or may be used as a basis for compensations. Compensations may be performed using hardware or software.

Compensations with the aid of software may be performed so that empirical error functions may be produced and possibly mathematical error functions may be produced from these empirical error functions, which are taken into consideration during the use of the tracking device for its control.

Compensations, in particular hardware compensations, are generally only performed if the angular errors exceed certain preselectable limiting values. For this purpose, the computer unit may compare the angular errors determined to preselectable limiting values.

The data processing system may have a printer unit in order to produce hard copies of data in connection with the method according to the present invention.

The data processing system preferably has a display unit.

Furthermore, the data processing system may have an input unit in order to completely or partially control the novel method, typically in combination with the display unit.

The present invention is used in particular to establish angular errors of main axes of sensors and/or effectors of tracking devices, the functional unit, more precisely the receiver of the sensor and/or effector, being rotatable directly around an axis of elevation and indirectly around a roll axis and a lateral axis. In this case, the sensor may be an image recording device, such as a TV camera, and the effector may be a weapon barrel, and the mounting surface for the tracking device may be a movable surface, for example, of a vehicle or ship, in particular a vehicle or ship deck.

The device may be autonomous in regard to its positioning device and/or decoupled from an external positioning device. However, it may be coupled to an external positioning device, for example, with the aid of a PSD device.

BRIEF DESCRIPTION OF THE DRAWINGS

Further details of the present invention are described in the following on the basis of an exemplary embodiment and with reference to the drawing.

DESCRIPTION OF THE PREFERRED EMBODIMENTS

Figure 1:
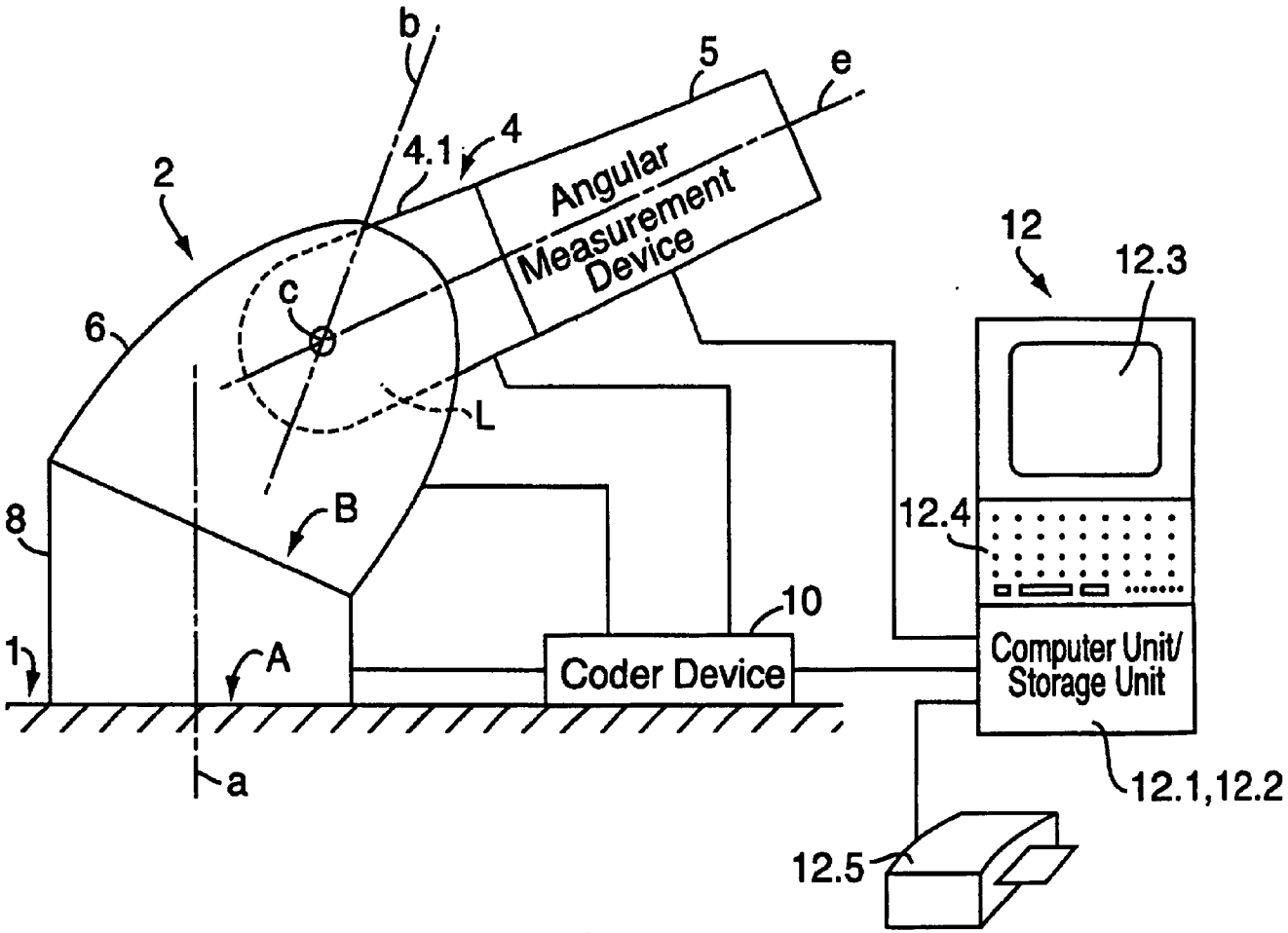
FIG. 1 shows a tracking device having a first device according to the present invention, in a greatly simplified, schematic illustration.

FIG. 1 shows a mounting surface 1 having a tracking device 2. In use, the tracking device 2 essentially comprises a functional unit 4, specifically a sensor or effector or an angular measurement device 5, as well as a carrier 6 and finally a carrier base 8. The functional unit is not a component of the device according to the present invention.

The functional unit 4 has a receiver 4.1. If the tracking device 2 is ready for use, it is attached to the receiver 4.1 of the sensor or effector, which has a main axis e. To perform the method according to the present invention, which is a test method, the triaxial angular measurement device 5 is temporarily attached to the receiver 4.1 in such a way that one of its measurement axes is coincident at least with the direction of the main axis e; a deviation of the measurement axis cited from its intended direction during a movement of the receiver 4.1 corresponds to the deviation of the main axis e during an identical movement of the receiver 4.1.

The functional unit 4 and/or the receiver 4.1 is/are rotatably coupled via an axis of elevation I to the carrier 6 and may be rotated relative to the carrier 6 along an upper plane of rotation L. In the arrangement shown in FIG. 1, the axis of elevation I is perpendicular and the upper plane of rotation L is parallel to the plane of the drawing, and the axis of elevation I is accordingly shown as a point. The axis of elevation I is horizontal in a resting state in the example described here. The angle of elevation $\lambda$ of the main axis e is set essentially by rotation around the axis of elevation I.

It will now be explained how the position and alignment of the angular measurement device 5 is determined during and/or after the mounting of the angular measurement device 5 and how deviations from the ideal and/or desired position and/or alignment are compensated. As already described, the angular measurement device 5 is attached to the receiver 4.1 in place of the sensor or effector used during use of the tracking device 2. If the angular measurement device 5 has a significantly lower mass than the sensor or effector, this must be compensated for by additionally positioning an equivalent mass at a suitable position. Subsequently, it is checked by rotation around the axis of elevation I, as described above, whether and by how much the position and alignment of the main measurement axis deviates from the main axis e. The compensation of this deviation may be performed through hardware by reworking and/or more precise mounting of the angular measurement device 5. However, the compensation may also be performed through software, in that the deviation is stored and is taken into consideration by the computer during the establishment and/or analysis of the results of the method according to the present invention.

The carrier 6 is rotatably coupled to the carrier base 8 via a roll axis b and may be rotated in relation to the carrier base 8 along a central plane of rotation B. The roll axis b is theoretically perpendicular to the axis of elevation I. A rotation is performed around the roll axis b to compensate for a roll angle $\beta$ which generally changes continuously in the event of a moving mounting surface 1.

The carrier base 8 is directly or indirectly positioned rotatably on the mounting surface 1 via a lateral axis a and is rotatable along a lower plane of rotation A in relation to the mounting surface 1. The lateral axis a is at a theoretical fixed angle $\phi$ to the roll axis b and is vertical in a resting state in the present example. The lateral angle $\alpha$ of the functional unit 4 and/or of the main axis e is set essentially through rotation around the lateral axis a.

It is to be noted here that in the present case the absolute elevation and lateral angle of the functional unit 4 and/or of the main axis e are not exclusively determined by the angle of elevation $\lambda$ and/or the lateral angle $\alpha$, because it is assumed that the mounting surface 1 moves but is not horizontal.

The tracking device 2 has a coder device 10 for each of the planes of rotation L, B, and A. Starting from a zero position in each case, the coder device 10 provides the intended change $\Delta\epsilon^*$ of the spatial angle of the main axis e during a rotation around one of the axes of rotation, i.e., around the axis of elevation I or around the roll axis b or around the lateral axis a, with simultaneous prevention of rotations around the respective other two axes of rotation. The rotations are performed in rotation steps, and the corresponding intended change $\Delta\epsilon^*$ is fixed after each rotation step.

Simultaneously, the actual change $\Delta\epsilon$ of the spatial angle of the main axis e is measured after each rotation step by the angular measurement device 5.

The intended changes $\Delta\epsilon^*$ and the associated actual changes $\Delta\epsilon$, which were obtained during the different determination procedures, are stored in the form of a table and may also be analyzed.

For this purpose, the angular measurement device 5 and the coder device, 10 are connected to a data processing system 12, a suitable laptop in the present case. The data processing system 12 has a storage unit 12.1 for storing the intended changes and the actual changes and possibly further data in connection with the method according to the present invention. Furthermore, the data processing system 12 has a computer unit 12.2; the computer unit 12.2 is used to produce a multidimensional matrix on the basis of the actual changes and the intended changes, taking the respective rotation directions and rotation steps into consideration. The respective tracking device tested and/or its geometrical deviations from its desired ideal configuration is represented by this matrix. Furthermore, the data processing system has a display unit 12.3 for displaying data in tabular and/or graphic form in connection with the method according to the present invention. Finally, the data processing system 12 has an input unit 12.4. The input unit 12.4, typically in combination with the display unit 12.3, is used both for analyzing the results of the determination procedures and for controlling the entire method according to the present invention. A printer unit 12.5 is used for producing hard copies of data which is connected to the novel method.

Figure 2:
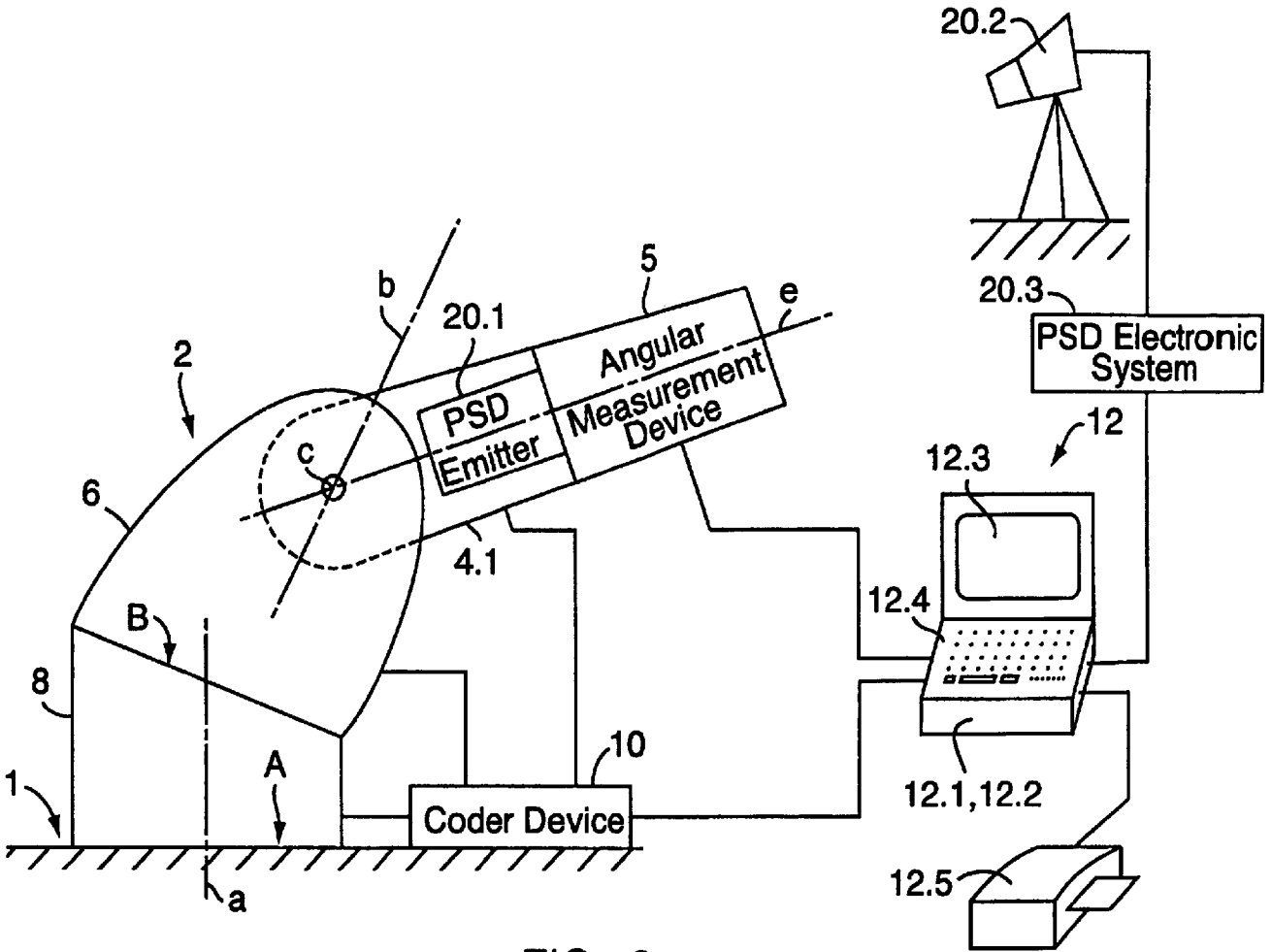
FIG. 2 shows the tracking device illustrated in FIG. 1 having a second device according to the present invention, in the same illustration as in FIG. 1.

The arrangement described in connection with FIG. 1 operates without external reference points. An arrangement as shown in FIG. 2 is advantageously used in particular if interaction with external units is intended. The arrangement shown in FIG. 2 is identically constructed in principle to the arrangement of FIG. 1, identical or corresponding parts are provided with identical reference numbers. In addition, the arrangement shown in FIG. 2 has a PSD device, with the aid of which linkage to an external reference system may be produced. The PSD device essentially comprises a PSD laser emitter 20.1, which is attached to the receiver, a PSD receiver 20.2, and a PSD electronic system 20.3.

What is claimed is:

1. A method for testing a system before it is operational by detecting internal defaults due to manufacturing and mounting inaccuracies, wherein the system comprises a sensor or effector having a main axis, a receiver in which the sensor or effector is received, the receiver being rotatable directly about a first axis of rotation and indirectly about at least one further axis of rotation, a coder device providing intended angles of the main axis for any of a plurality of positions of the receiver, and wherein the inaccuracies resulting, for each position of the receiver in an angle difference between the actual angle of the main axis and the intended angle of the main axis, the method comprising the steps of attaching to the receiver an optical-electronic angular measurement device having at least two measurement axes and being adapted to provide actual changes of angles of the main axis, performing a determining procedure for the first axis of rotation axis or one of the further axes of rotation, while any rotation about the other axes is prevented, and after each rotation step providing a first actual change of the spatial angle of the main axis by the angular measurement device and storing the first actual change, and providing a first intended change of the spatial angle of the main axis by the coder device of the system and storing the first intended change.

2. The method according to claim 1, wherein the determination procedure is performed for the at least one further axis of rotation in which a rotation is performed in rotation steps around the at least one further axis of rotation, while rotations around the first and possibly even further axes of rotation are prevented, and after each rotation step a second actual change of the spatial angle of the effector main axis is detected by the angular measurement device and stored, and a second intended change of the spatial angle of the effector main axis is provided and stored by a coder device.

3. The method according to claim 1, wherein that angular errors are established and stored as differences between the actual changes and the associated intended changes, a matrix being formed and logged using the detected angular errors.

4. The method according to claim 3, wherein, after the angular errors are determined, a comparison is performed, in which the angular errors are compared to a pre-selectable limiting value, which is greater than or equal to 0°.

5. The method according to claim 4, wherein measures to compensate for at least part of the angular errors are performed if the angular errors are greater than the pre-selectable limiting values.

6. The method according to claim 5, wherein the measures to compensate for the angular errors comprise a change of the implementation or positioning of at least one of the components which cause the angular errors.

7. The method according to claim 5, wherein, after an angular error is compensated for, one or more further determination procedures and comparisons and, if necessary, further measures to compensate for the angular error after each comparison are performed.

8. The method according to claim 5, wherein the measures to compensate for at least part of the angular errors are performed using a computer.

9. The method according to claim 1, wherein, before the first determination procedure is performed, the spatial axial deviation of a main measurement axis of the angular measurement device from the main axis is determined, and measures to compensate for this axial deviation are performed.

10. The method according to claim 9, wherein the measures to compensate for the axial deviation include a change of the positioning of the optical-electronic angular measurement device.

11. The method according to claim 9, wherein the measures to compensate for the axial deviation are performed using a computer while the actual changes of the angle are determined.

12. The method according to claim 1, wherein the method is performed at least semi-automated, but with the possibility of a manual intervention with the aid of an input unit and preferably a display unit.

13. The method according to claim 1, wherein data is retained in a storage unit or in a hard copy using a printer unit.

14. The method according to claim 1, wherein a linkage to an external system is performed with the aid of a PSD device.

15. A device for testing a system wherein the system comprises a sensor or effector having a main axis, a receiver to which the sensor or effector is attached, the receiver being rotatable directly about a first axis of rotation and indirectly about at least one further axis of rotation, a coder device providing intended angles of the main axis for any of a plurality of positions of the receiver, and wherein the inaccuracies resulting, for each position of the receiver in an angle difference between the actual angle of the main axis and the intended angle of the main axis, the device having means for testing a system before it is operational by detecting internal defaults due to manufacturing and mounting inaccuracies, and an optical-electronic angular measurement device, attachable to the receiver, the measurement device having at least two measurement axes, to detect the actual changes of the spatial angle of the main axis during rotations around only one of the axes of rotation, and a storage unit to store the intended changes and the associated actual changes.

16. The device according to claim 15, wherein the optical-electronic angular measurement device has a total of three measurement axes, which are preferably orthogonal to one another, and is preferably attachable to the receiver in such a way that, within the scope of typical manufacturing and mounting precision, one of the measurement axes is coincident at least in direction with the main axis.

17. The device according to claim 15, wherein the angular measurement device has a laser gyro.

18. The device according to claim 15, wherein the device includes a data processing system, having a computer unit for calculating angular errors as differences between the actual changes determined by the angular measurement device and the intended changes provided by the coder device.

19. The device according to claim 18, wherein the computer unit is implemented for the purpose of establishing an angular error difference between a calculated angular error and a pre-selectable limiting value.

20. The device according to claim 17, wherein the computer unit is implemented for the purpose of producing a matrix on the basis of the actual changes and intended changes.

21. The device according to claim 17, wherein the data processing system has a printer unit in order to produce hard copies of at least part of the established data.

22. The device according to claim 17, wherein the data processing system has an input unit to control functions of the coder device or of the angular measurement device or of the data processing system.

23. The device according to claim 15, wherein the device is de-coupled from external positioning devices.

24. The device according to claim 15, wherein the device may be coupled to an external positioning device using a PSD device.

25. A use of the device according to claim 15, wherein a carrier base, onto which the receiver is attached via a carrier, is directly or indirectly attachable to a movable mounting surface.

26. A use of the device according to claim 15, wherein the receiver, the carrier, and the carrier base, are parts of a tracking device, which is intended for the purpose of being aligned with the position of an external object through correlation of the main axis.

27. The use according to claim 26, wherein the tracking device is an optical tracking device and the main axis is the main axis of an image recording device which forms the sensor.

28. The use according to claim 26, wherein the tracking device is an artillery weapon and the main axis is the main axis of a weapon barrel which forms the effector.

* * * * *

UNITED STATES PATENT AND TRADEMARK OFFICE

CERTIFICATE OF CORRECTION

PATENT NO. : 7,110,101 B2
APPLICATION NO. : 10/461743
DATED : September 19, 2006
INVENTOR(S) : Gabriel Schneider It is certified that error appears in the above-identified patent and that said Letters Patent is hereby corrected as shown below:

On Title page item 73
Please add the Assignee information to the front page of the Issued Patent. It should read as follows:

--OERLIKON CONTRAVES AG, ZURICH, (CH)--

Signed and Sealed this

Twelfth Day of December, 2006

JON W. DUDAS
*Director of the United States Patent and Trademark Office*